United States Patent [19]

Obata et al.

[11] Patent Number: 5,042,171

[45] Date of Patent: Aug. 27, 1991

[54] CLOTHES DRYER

[75] Inventors: Yukio Obata; Hitoshi Ogasahara, both of Yokohama; Hiroo Nakamura, Niihari, all of Japan

[73] Assignee: Hitachi, Ltd., Tokyo, Japan

[21] Appl. No.: 384,827

[22] Filed: Jul. 25, 1989

[30] Foreign Application Priority Data

Aug. 10, 1988 [JP] Japan ..... 63-197907
Oct. 26, 1988 [JP] Japan ..... 63-268234

[51] Int. Cl.[5] ..... F26B 11/02
[52] U.S. Cl. ..... 34/133; 432/105; 432/107
[58] Field of Search ..... 432/103, 105, 107; 34/133, 131, 86

[56] References Cited

U.S. PATENT DOCUMENTS 3,969,070 7/1976 Thompson ..... 432/107
4,204,338 5/1980 Bullock ..... 432/105

FOREIGN PATENT DOCUMENTS 49-14180 4/1974 Japan .
55-78996 6/1980 Japan .

OTHER PUBLICATIONS

All-Round Catalogue of Built-In Apparatus by AEG.
Catalogue of Built-In Full Automatic Washer.
Catalogue of Full-Automatic Washer with Dryer.
All-Round Catalogue of Bosch Ltd., '87-12.

*Primary Examiner*—Henry C. Yuen
*Attorney, Agent, or Firm*—Antonelli, Terry, Stout & Kraus

[57] ABSTRACT

A clothes dryer equipped with a condensation unit (23, 38, 73) in which the cooling water that is fed is brought into direct contact with the humid air to dehumidify the humid air. The condensation unit (23, 38, 73) of the clothes dryer comprises a first duct (24, 39, 75) connected at its one end to the delivery portion of the circulating fan (20) and arranged with its other end being directed downwardly of the dryer housing; a second duct (25, 40, 76) connected at its one end to the other end of the first duct (24, 39, 75) and connected at its other end to the heater duct (**8*d*); a cooling water pouring port for feeding cooling water to the second duct; cooling means for bringing the cooling water into direct contact with the humid air; and a water drain port for draining from the second duct (25, 40, 76**) the water condensed from the humid air and the cooling water.

11 Claims, 9 Drawing Sheets

CLOTHES DRYER

BACKGROUND OF THE INVENTION

The present invention relates to a clothes dryer equipped with a condensation unit in which a drum containing laundry that is to be dried is horizontally supported by bearings and which is capable of condensing the water in the humid air sent from the drum. More specifically, the invention relates to a clothes dryer which suppresses the rise in temperature and humidity in the room when the dryer is in operation, which is small in size and which makes it easy to find a place for installation.

For example, Japanese Patent Laid-Open No. 36599/1983 discloses a clothes dryer in which the humid air produced from the laundry contained in a drum during the operation is cooled, the water in the humid air is condensed to lower the absolute humidity, the air is heated by a heater and is supplied again to the drum.

The above clothes dryer has a heat exchanger, and the humid air from the drum (laundry) is sent to the heat exchanger. The temperature of the humid air is lowered by the heat exchanger that is cooled by a cooling fan, such that the water in the air is condensed. The condensed water is drained out of the dryer. Furthermore, the dehumidified air from the heat exchanger having lowered temperature and lowered absolute humidity is heated by the heater, and blown and is recirculated into the drum.

According to the above prior art, the high-temperature and humid air vaporized from the laundry and sent from the drum is sent to the heat exchanger to effect the condensation. The heat exchanger is cooled by the air sucked from the room by the cooling fan. Here, the air (used for cooling) having elevated temperature is sent into the room, and problems are involved as described below.

(1) The temperature of the external air (i.e., the air in the room) for cooling the heat exchanger gradually rises with the passage of operation time, and the degree of offensive feeling of the dwellers increases.

(2) The place for installing the clothes dryer is limited to a spot where the external air can be easily taken in to cool the heat exchanger and then exhausted.

(3) The humid air condensing unit must be provided with a heat exchanger and a cooling fan, causing the clothes dryer to become bulky.

SUMMARY OF THE INVENTION

The object of the present invention is to provide a small clothes dryer which is free from the above-mentioned assignments inherent in the prior art, which does not cause the temperature in the room to rise during the drying operation, and which does not limit selection of a place for installation.

In order to achieve the above-mentioned object, the clothes dryer of the present invention has a drum that is horizontally supported by bearings in the dryer housing. The humid air containing water vaporized from the laundry contained in the drum is sent from the drum into a condensation unit by a circulating fan. The condensation unit cools the humid air, condenses the water contained therein and removes it. In the clothes dryer of the present invention, the air after dehumidification is heated through a heater, sent again into the drum and is circulated to dry the laundry. Here, the condensation unit has a first duct of which the one end is connected to the delivery side of a fan casing of the circulating fan and of which the other end is arranged being directed downwardly of the dryer, a second duct of which the one end is connected to the lower end of the first duct and of which the other end is connected to the heater-containing unit, a cooling water pouring port for supplying cooling water into the first and second ducts to cool the humid air, and a drain port for draining through the first and second ducts the cooling water and water condensed from the humid air.

Desirably, the second duct rises from the lower end of the first duct in a tilted manner. Or, there are provided a cooling water-containing portion formed in the bottom of the second duct to store water, and a drain pipe that rises from the bottom surface of the cooling water-containing portion. When the cooling water-containing portion is provided, either one of the following two constitutions should be employed.

First constitution

Provision is made of a water inlet port opened in a lower side portion of the cooling water-containing portion, a water jet pump mounted on an side upper portion of the cooling water-containing portion, and a suction pipe that connects the water jet pump to the water inlet port. The water jet pump consists of a nozzle and a suction portion which has a blow port that is provided in front of the nozzle and that blows water into the second duct and a suction port to which the suction pipe is connected. The suction portion is so formed as to surround the nozzle.

Second constitution

The cooling water-containing portion has a nozzle in the bottom surface thereof with its blow port being directed upwards.

The clothes dryer of the present invention has a novel condensation unit instead of the heat exchanger and the cooling fan that were used so far. In the condensation unit, the water in the humid air from the drum is condensed by lowering the temperature and the absolute humidity of the humid air based on the method of bringing the tap water (hereinafter referred to as cooling water) supplied via the feed-water solenoid valve into direct contact with the humid air. In the clothes dryer of the present invention, furthermore, after the water is condensed from the air, the air is heated by the heater and is again blown into the drum. The drying operation is carried out by the above circulation path. In this case, the duct that communicates the humid air exhaust side of the drum with the heater that heats the air after the water is condensed, is provided with a resistor which widens and softens the flow of the cooling water.

Or, in the above-mentioned case, the cooling water is sprinkled into the duct like a shower. Thus, the contact time between the humid air and the cooling water is lengthened, and the contact area between the humid air and the cooling water is increased.

In another case according to the present invention, furthermore, the cooling water is injected and sprinked into the humid air which is then temporarily stored in the cooling water-containing portion provided at the bottom of the duct. Part of the cooling water staying in the cooling water-containing portion is sucked up by the water jet pump operated by the jet of cooling water supplied from the feed-water solenoid valve, mixed with the cooling water, and is injected and sprinkled.

In another case according to the present invention, furthermore, the cooling water supplied from the feed-water solenoid valve is injected into the cooling water-containing portion via a nozzle, such that the cooling water in the cooling water-containing portion is agitated and splashed to bring it into contact with the humid air.

The heat exchanging efficiency is thus improved between the cooling water and the humid air. Preferably, a cap-like cylinder is arranged in the cooling water-containing portion so as to cover the rising portion of the water drain pipe. This enables the opening of the water drain pipe to exhibit a siphon function. This structure prevents the leakage of the humid air from the water drain pipe to the outside of the dryer housing.

According to the present invention, the humid air from the drum is cooled by the cooling water and the water contained therein is condensed and is removed. Unlike the prior art, therefore, there is no need of taking the external air into the dryer or exhausting the air therefrom. Accordingly, there is no need of limiting the place for installing the dryer to such an area where the air can be easily taken into the dryer and can be exhausted therefrom. Furthermore, only the heat radiated from the dryer contributes to increasing the temperature in the room where the clothes dryer is installed; i.e., the temperature in the room rises little and comfortability is not impaired. Moreover, the condensation unit is constituted by the ducts, the cooling water pouring port for supplying the cooling water thereto, and the drain port for draining the water from the ducts, requiring neither the cooling fan nor the heat exchanger. Therefore, the dryer is reduced in size, simplified in construction and its manufacturing cost is decreased. Furthermore, the contact time between the humid air from the drum and the cooling water is lengthened and the contact area is also increased, making it possible to improve heat transfer efficiency from the humid air to the cooling water and to decrease the rate of feeding the cooling water.

When the cooling water-containing portion is provided, furthermore, the cooling water supplied via the water-feed electromagnetic valve and the cooling water in the cooling water-containing portion having cooling ability are injected and sprinkled, being mixed together through the water jet pump (or the nozzles) so that the humid air is cooled. Therefore, the cooling water is used efficiently and the cooling water needs to be supplied in reduced amounts.

In effect, according to the present invention, there is provided a small clothes dryer which does not cause the temperature in the room to rise during the drying operation and which does not impose limitation in finding a place for installation.

DETAILED DESCRIPTION OF THE PREFERRED EMBODIMENTS

Figure 1:
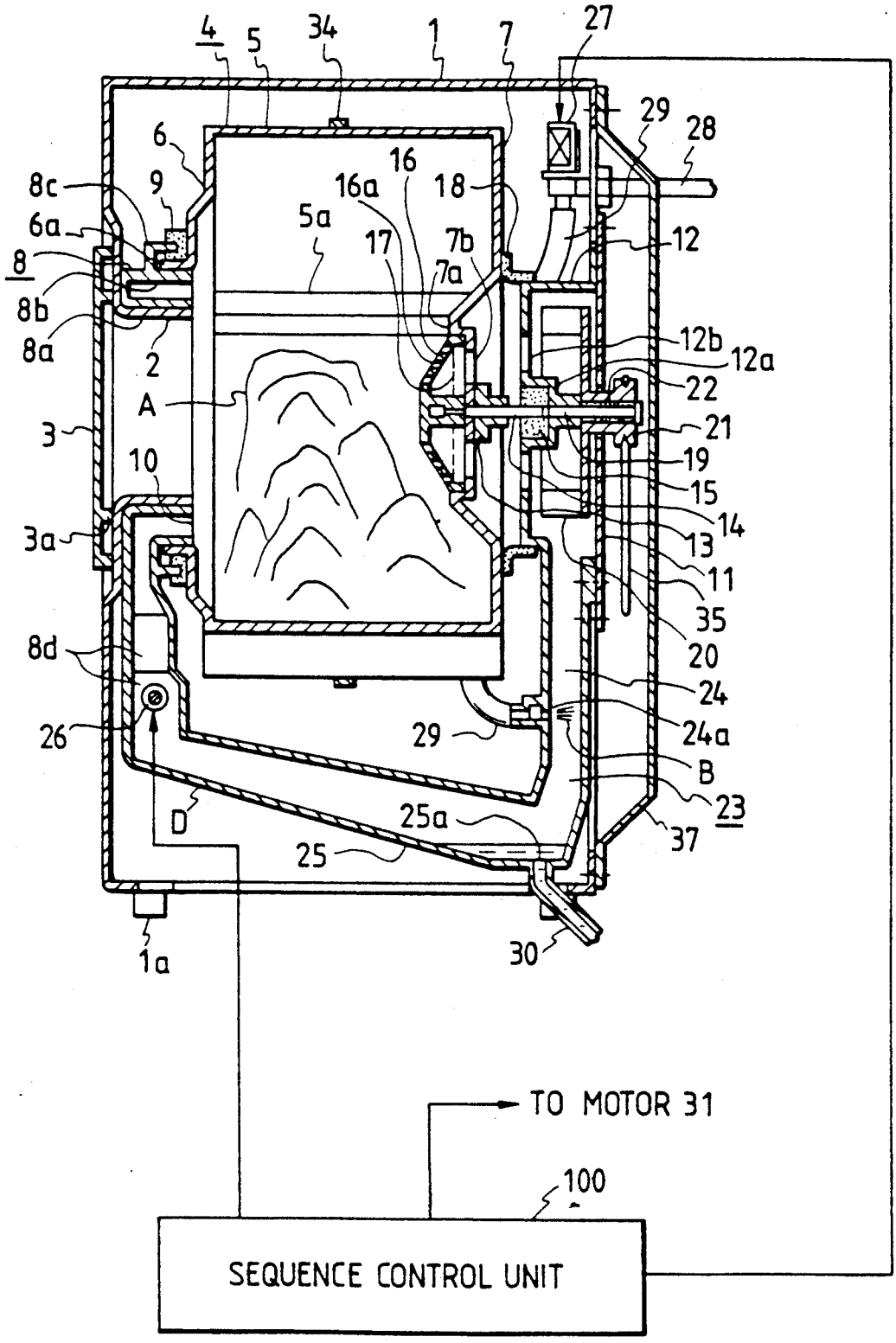
FIG. 1 is a vertical section view illustrating a clothes dryer according to a first embodiment of the present invention.
Figure 2:
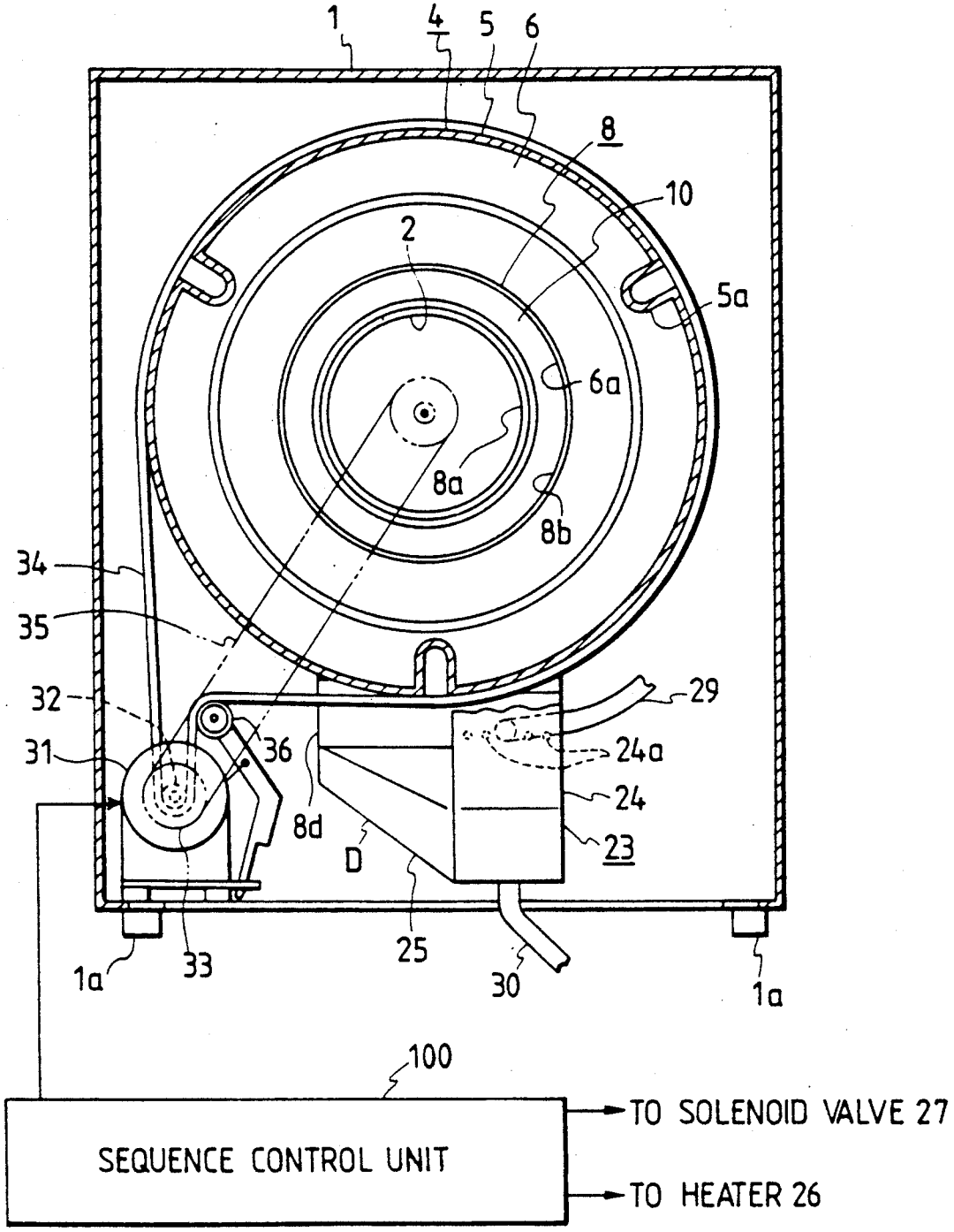
FIG. 2 is a vertical section view illustrating the first embodiment as viewed from a direction at right angles with the surface of paper of FIG. 1.

FIG. 1 is a vertical section view illustrating a clothes dryer according to a first embodiment of the present invention, and FIG. 2 is a vertical section view as viewed from a direction at right angles with the surface of paper of FIG. 1.

The clothes dryer according to this embodiment has a drum 4 that is a drying vessel horizontally supported by bearings in the dryer housing. The humid air containing water vaporized from the laundry A contained in the drum 4 is expelled by a circulating fan 20 from the drum 4 and is sent to a condensation unit (which will be described later in detail). Owing to the cooling water supplied from a feed-water solenoid valve 27, the condensation unit cools the humid air to condense and remove water contained therein. The air after dehumidification is sent to a heater 26 where it is heated, and is sent again into the drum 4 to circulate. The laundry A is thus dried.

The condensation unit consists of a first duct 24 which extends downwardly from the delivery side of a casing of the circulating fan 20, a second duct 25 which rises in a tilted manner from the lower end of the first duct 24 up to a heater duct **8*d* of a drum support member 8 in the heater-containing unit (the first duct 24 and the second duct 25 together are represented by a duct D), a spray port 24*a* (which consists of a plurality of small holes perforated in the side surface of the first duct 24) for supplying the cooling water that cools the humid air, and a drain port 25*a*** for draining the cooling water and the condensed water formed from the humid air.

In FIG. 1, reference numeral 1 denotes an outer frame which is a housing supported by rubber legs **1*a*. Reference numeral 2 denotes an opening through which the laundry can be thrown in or taken out and which is provided at a central portion in the front surface 25 of the outer frame 1. Reference numeral 3 denotes a cover which is hingedly attached to the throwin/take-out opening 2 such that the edge 3*a* of the cover comes into intimate contact with the throw-in/take-out opening 2**.

And when it is closed, and reference numeral 4 denotes a drum which is horizontally supported by bearings in the outer frame 1 and which works as a drying vessel. The drum 4 is provided with a cylindrical portion 5 and side plates 6, 7. The cylindrical portion 5 is provided with a lifter 5*a* which is protruded along the inner circumference toward the center to agitate the laundry A during the drying operation. The side plate 6 has a drum portion 6*a* supported by a bearing 9 which is secured to the drum support member 8 that will be described later. The side plate 7 has exhaust ports 7*b* perforated in a protruded portion 7*a* formed at the central portion and being directed inwardly to exhaust the humid air containing water vaporized from the laundry A. Reference numeral 8 denotes a drum support member secured to the central inner side on the front surface of the outer frame 1. The drum support member 8 is constituted by a drum portion 8*a* inserted in the throw-in/take-out opening 2, a drum portion 8*b* in which is inserted the drum portion 6*a* of the side plate 6 of drum 4, a drum portion 8*c* to which is secured the bearing 9 that will be described below, and a heater duct 8*d* which heats the air after dehumidification and guides it to a hot air blow port 10 that will be described below. The bearing 9 has the shape of a ring and is made of a plastic material (such as polyacetal or the like) having abrasion resistance or a felt having small friction. Hot air blow port 10 is for blowing the hot air into the drum 4 through a gap between the drum portions 8*a* and 8*b* of the drum support member 8.

Reference numeral 11 denotes a bearing board fastened to the rear surface of the outer frame 1, and reference numeral 12 denotes a casing of fan 20 having a bearing cylinder 12*a* formed like a cylinder at the central portion thereof. The casing 12 is provided for the circulating fan 20 that is described in more detail later. The casing 12 has inlet ports 12*b* perforated in the peripheral portion of the bearing cylinder 12*a* to take in the humid air from the drum 4. The casing 12 of the fan is fastened to the bearing board 11. Reference numeral 13 denotes a hub of drum 4 which is secured to the central portion (i.e., axis of the drum 4) of the protruded portion 7*a* on the side plate 7 of the drum. Reference numeral 14 denotes a drum shaft tightly fitted into the drum hub 13. The drum shaft 14 is supported by a bearing 15 fitted into the bearing cylinder 12*a*, and whereby the drum 4 is rotatably supported.

Reference numeral 16 denotes a protection cover which is detachably attached to a portion of the drum shaft 14 that protrudes into the drum 4. The protection cover 16 has ventillation holes 16*a* which are formed like a grid over the whole area thereof to protect the laundry A. Reference numeral 17 denotes a mesh-like cloth chip filter which is fitted to the back surface of the protection cover 16 to trap cloth chips produced from the laundry A during the drying operation.

Reference numeral 18 denotes a felt ring which is secured to the fan casing 12 and is brought at its outer peripheral portion into pressed contact with the side plate 7 of the drum 4 to maintain air-tightness. Reference numeral 19 denotes a fan shaft which is tightly inserted into the end of the bearing cylinder 12*a*, and reference numeral 20 denotes the circulating fan which is rotatably supported by the fan shaft 19, which intakes from the drum 4 the humid air containing water vaporized from the laundry A, and which circulates the humid air into a condensation unit 23 (which will be described later in detail), a heater 26 and the drum 4. Reference numeral 21 denotes a fan pulley formed together with the circulating fan 20 as a unitary structure, 22 denotes a bearing tightly inserted into the central portion of the circulating fan 20 (i.e., into center of the fan pulley 21), and 37 denotes a back cover.

The condensation unit 23 consists of the first duct 24 and the second duct 25. The first duct 24 has a spray port 24*a* consisting of a plurality of small holes perforated in the side surface thereof to spray the cooling water like a shower into the humid air to cool it. The first duct 24 is connected to the delivery side of the fan casing 12 and is directed downwardly in the dryer housing. The second duct 25 has a drain port 25*a* in the bottom thereof to drain the cooling water sprayed in the first duct 24 out of the housing. The second duct 25 is connected at its one end to the lower end of the first duct 24, gradually rises, and is connected at its other end to the heater duct 8*d* of the drum support member 8.

Reference numeral 26 denotes a heater which is a source of heat for drying placed, via an electric insulator, in the heater duct 8*d* of the drum support member 8. Reference numeral 27 denotes a feed-water solenoid valve of the type of small flow rate which is provided to feed the cooling water that is to be sprayed into the duct D. A feed-water hose 28 connects the solenoid valve 27 to the tap (not shown) of city water. A pouring hose 29 connects the delivery side of the feed-water solenoid valve 27 to the spray port 24*a* of the first duct 24. A drain hose connected to the drain port 25*a* of the second duct 25.

In FIG. 2, reference numeral 31 denotes a motor for driving the drum 4 and the circulating fan 20. To both ends of the shaft of the motor 31 are fastened a pulley 32 for driving the drum and a pulley 33 for driving the circulating fan 20. Reference numeral 34 denotes a belt which turns round the outer periphery of the drum 4 and the pulley 32, and 35 denotes a belt which turns round the fan pulley 21 of the circulating fan 20 and the pulley 33. Reference numeral 36 denotes a wheel that gives tension to the belt 34. Reference numeral 100 denotes a sequence control unit for controlling the operation of the heater 26, solenoid valve 27 and motor 31.

Described below is the operation of the thus constituted clothes dryer.

The user throws the laundry A into the drum 4, closes the cover 3, and turns on the clothes dryer of this embodiment (actuates the sequence control unit 100). As the clothes dryer is turned on, the motor 31 rotates and the drum 4 rotates at a speed of 40 to 50 rpm. The circulating fan 20 rotates, too, and, at the same time, the solenoid valve 27 is opened such that the cooling water B is sprayed into the duct D. The laundry A in the drum 4 is lifted up by the lifter 5*a* and falls in a manner to be agitated. The air blown in to the duct D from the delivery side of the casing 12 of the circulating fan 20 is heated by the heater 26 which is served with electric power and becomes hot air having a relative humidity of, generally, smaller than 2%. The hot air is blown from the hot air blow port into the drum 4, comes into contact with the laundry A, vaporizes the water contained therein, and whereby the humid air containing vaporized water is sent from the drum 4 into the first duct 24.

The hot air in the duct 24 comes in contact with the cooling water sprayed like a shower from the spray port 24*a* and is cooled. The water in the humid air is condensed such that the temperature and the relative humidity decrease. The air after dehumidification is heated by the heater 26 and is supplied again into the drum 4. The laundry A is dried as the air circulates. The condensed water is drained out of the dryer housing from the drain port 25*a* via the drain hose 30 together with the cooling water whose temperature is elevated after having received the heat from the humid air.

According to the first embodiment described in the foregoing, the cooling water is sprayed like a shower into the humid air that contains water vaporized from the laundry and that is sent from the drum. Therefore, the contact area increases between the humid air and the cooling water, and the heat is efficiently transferred from the humid air to the cooling water. Therefore, the cooling water is used in reduced amounts.

Figure 3:
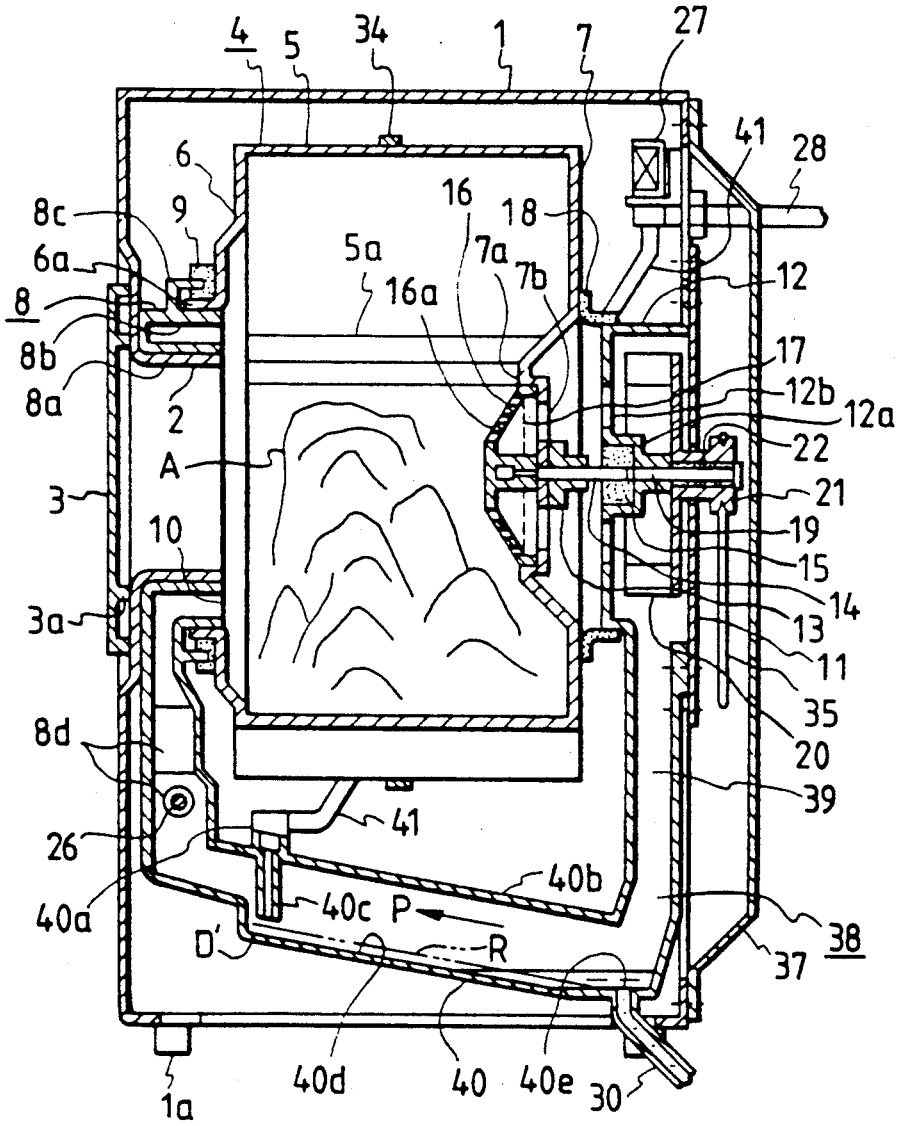
FIG. 3 is a vertical section view illustrating the clothes dryer according to a second embodiment of the present invention.
Figure 4:
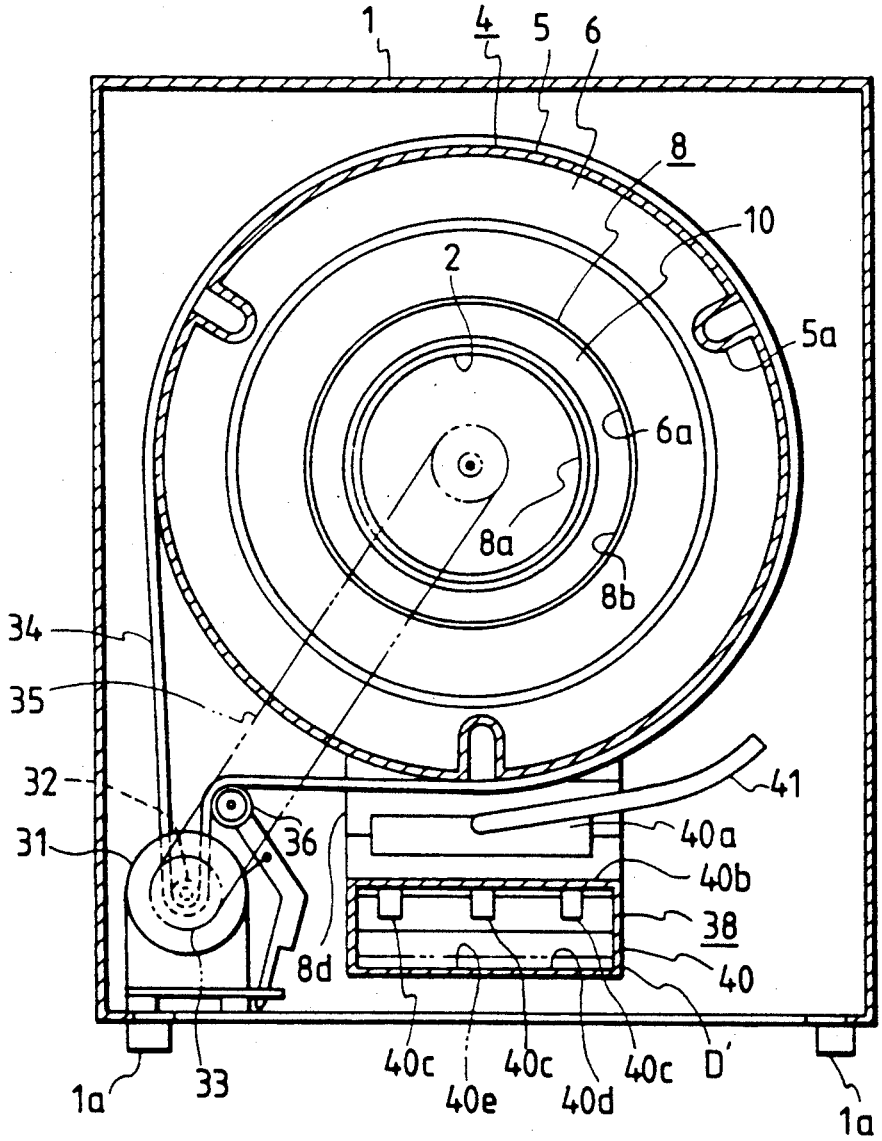
FIG. 4 is a vertical section view illustrating the second embodiment as viewed from a direction at right angles with the surface of paper of FIG. 3.
Figure 5A:
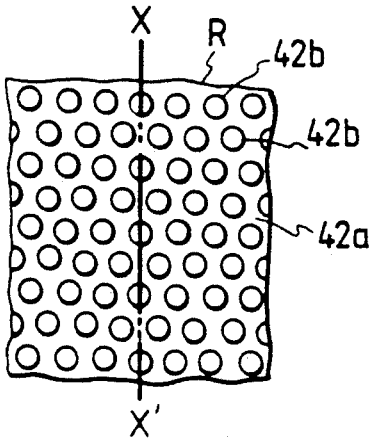
FIGS. 5 to 7 are views illustrating on an enlarged scale examples of the resistor in FIG. 3.
Figure 5B:
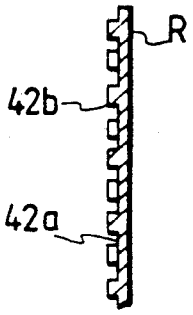
Figure 6A:
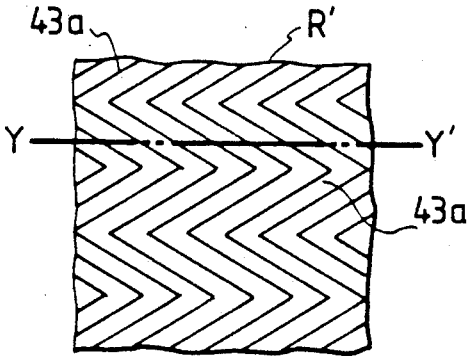
Figure 6B:
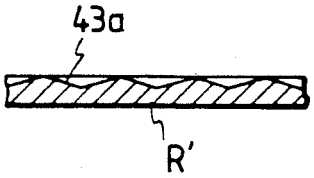
Figure 7:
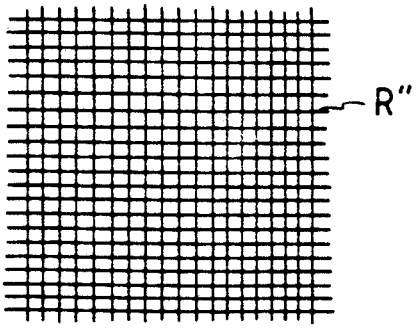

FIG. 3 is a vertical section view of the clothes dryer according to a second embodiment of the present invention. FIG. 4 is a vertical section view as viewed from a direction at right angles with the surface of paper of FIG. 3. FIGS. 5 to 7 are views illustrating on an enlarged scale a major portion of some examples of the resistor of FIG. 3.

In FIGS. 3 and 4, the same reference numerals as those of FIGS. 1 and 2 denote the same portions. Here, the sequence control unit 100 is not described.

This embodiment is different from the first embodiment only in the structure of the condensation unit for condensing water in the humid air; i.e., they are the same in other respects. Therefore, the following description deals with only the condensation unit for condensing water in the humid air employed in the second embodiment.

Reference numeral 38 denotes the condensation unit employed in this embodiment, which consists of a first duct 39, a second duct 40 and a resistor R. The first duct 39 is connected at its one end to the delivery side of the fan casing 12 and is arranged being directed downwardly of the dryer housing. The second duct 40 is connected to the lower end of the first duct 39, gradually rises, and is connected at its other end to the heater duct 8*d* of the drum support member 8. Here, the first duct 39 and the second duct 40 together are represented by a Duct D'. The resistor R is mounted on the bottom surface of the second duct 40.

Reference numeral 40*a* denotes a pouring port which is formed in the upper plate 40*b* of the second duct 40 at the final rising end to pour the cooling water into the duct D', reference numeral 40*c* denotes a plurality of pouring pipes that extend downwardly from the pouring port 40*a* up to the final end surface of the bottom portion 40*d* of the second duct 40. A drain port 40*e* drains the water poured into the duct D' out of the dryer housing. Reference numeral 41 denotes a pouring hose for connecting the delivery side of the solenoid valve to the pouring port 40*a*.

The resistor R is mounted on the bottom portion 40*d* such that the cooling water poured into the duct D' from the pouring pipe 40*c* via solenoid valve 27 flows mildly on the bottom portion 40*d* tilted in a direction opposite to the circulating direction (direction of arrow P) of the humid air, and then flows over a wide area into the drain port 40*e*. Referring to FIG. 5, the resistor R consists of a flat plate 42*a* on which are arranged circular small protuberances 42*b* maintaining an equal pitch in the lateral direction and also maintaining an equal pitch in the vertical direction but being deviated relative to the neighboring ones. FIG. 5(*a*) is a plan view of the resistor R, and FIG. 5(*b*) is a section view along the line X—X' of FIG. 5(*a*). Thus, with the resistor R being mounted on the bottom portion 40*d*, the cooling water that flows thereover is dispersed to the right and left due to circular small protuberances 42*b*. Therefore, the flow of the cooling water is broadened and becomes mild.

The thus constituted clothes dryer of FIG. 3 carries out the drying operation in the same manner as in the embodiment of FIG. 1. The humid air from the drum 4 is sent to the second duct 40 via the first duct 39. In the second duct 40, the cooling water is poured from the plurality of pouring pipes 40*c* through the solenoid valve 27, and flows mildly spreading over the bottom portion 40*d* being disturbed by the resistor R. The humid air is cooled upon contact with the cooling water, and whereby the water in the humid air is condensed such that the temperature and relative humidity are lowered. The air after dehumidification is heated by the heater 26, supplied again to the drum 4 and is circulated.

According to the second embodiment, the humid air which contains water vaporized from the laundry A and is sent from the drum 4 comes into contact with the cooling water that mildly flows spreading over the bottom portion 40*d* of the second duct 40 that is downwardly tilted in a direction opposite to the circulating direction (indicated by arrow P) of the humid air. Therefore, the contact time between the humid air and the cooling water is lengthened, the contact area is widened, and the heat is efficiently transferred from the humid air to the cooling water. Accordingly, the amount of cooling water fed to condense water in the humid air can be reduced compared with that of the first embodiment.

Other examples of the resistor R will be described in conjunction with FIGS. 6 and 7.

Referring to FIG. 6, the resistor R' consists of a flat plate in which shallow V-shaped grooves 43*a* are engraved in a tilted direction alternatingly and are connected together. FIG. 6(*a*) is a plan view of the resistor R' and FIG. 6(*b*) is a section view along the line Y—Y' of FIG. 6(*a*). With the resistor R' being mounted on the bottom portion 40*d*, the cooling water flows thereover aslantly along the V-shaped grooves 43*a*; i.e., flow of the cooling water becomes broad and mild.

With reference to FIG. 7, the resistor R" consists of a grid-like mesh, a coarse woven fabric, or a non-woven fabric obtained by intermingling the yarns. With the resistor R" being mounted on the bottom portion 40*d*, the cooling water that flows thereover is spread in the vertical and lateral directions to form a mild flow.

Figure 8:
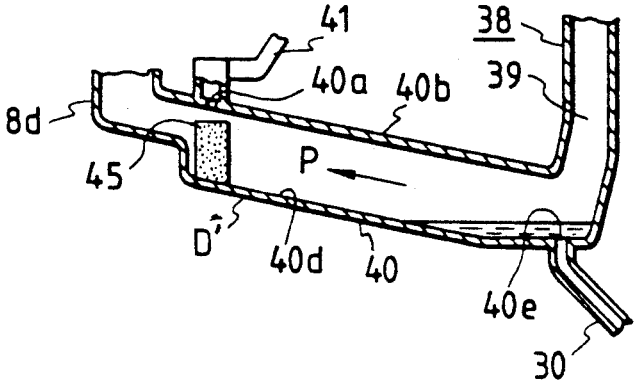
FIG. 8 is a section view illustrating a major portion of the duct in the clothes dryer according to a third embodiment of the present invention.

FIG. 8 is a section view illustrating a major portion of the duct in the clothes dryer according to a third embodiment of the present invention.

According to the third embodiment, a resistor 45 is mounted on a portion opposed to the pouring port 40*a* instead of the resistor R in the second embodiment of FIG. 3.

That is, the resistor 45 is fixed on the bottom portion 40*d* of the second duct 40 at a place opposed to the pouring port 40*a*. The resistor 45 is made of a material which permits the water to pass through and exhibits air permeability, such as a coarse woven fabric, a nonwoven fabric obtained by intermingling the yarns, or a coarse sponge.

Being constituted as described above, the cooling water supplied from the pouring port 40*a* into the duct D' mildly flows through the resistor 45, and comes into contact with the humid air that is blown in the humid air circulating direction (indicated by arrow P) to cool it. Therefore, the contact time between the two increase, the contact area increases, and the heat is efficiently transferred from the humid air to the cooling water. Moreover, the feeding amount of the cooling water can be decreased.

If mentioned concretely, the required feeding amount of the cooling water is from 0.23 to 0.40 liter per minute for 1 kW of the heat supplied by the heater 26 when the temperature of water is 20° C.

Figure 9:
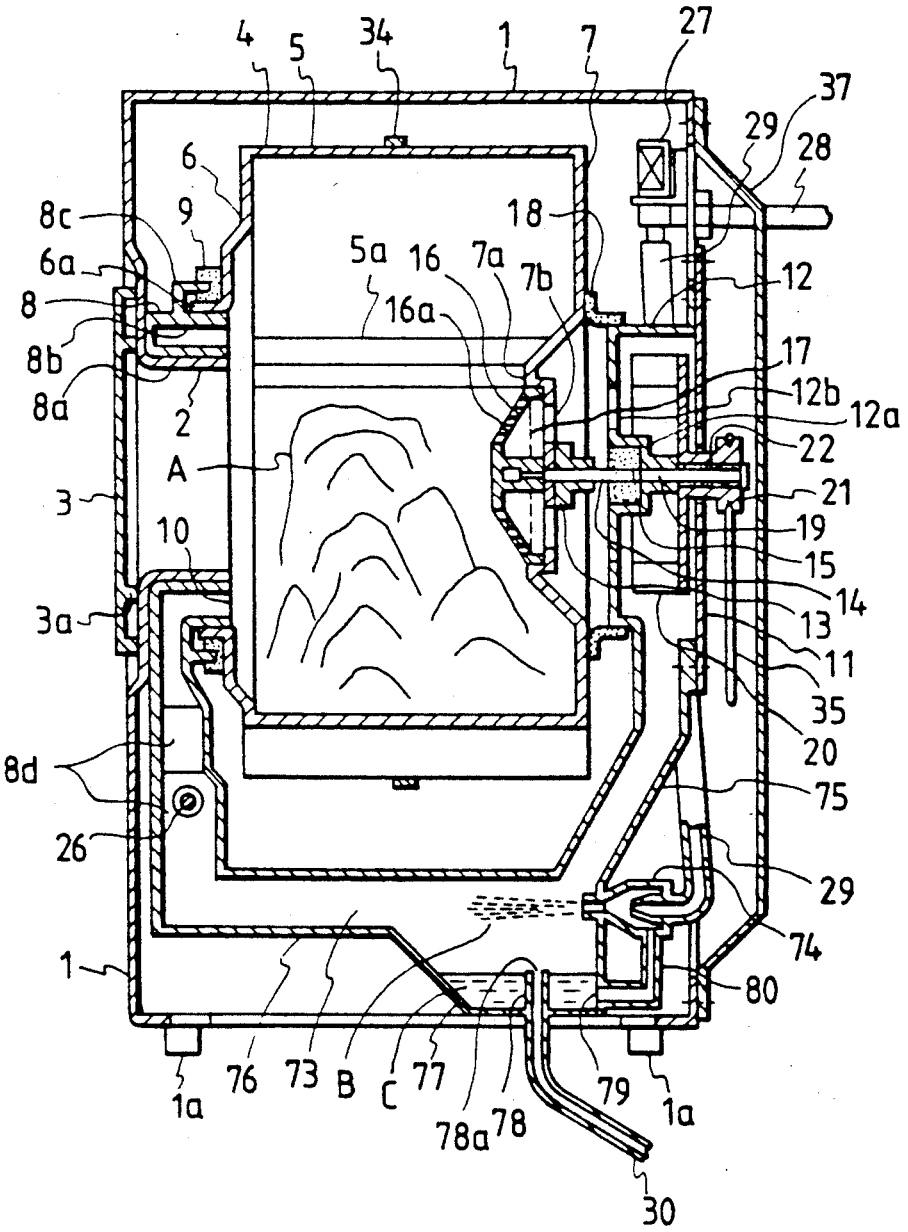
FIG. 9 is a vertical section view illustrating the clothes dryer according to a fourth embodiment of the present invention.
Figure 10:
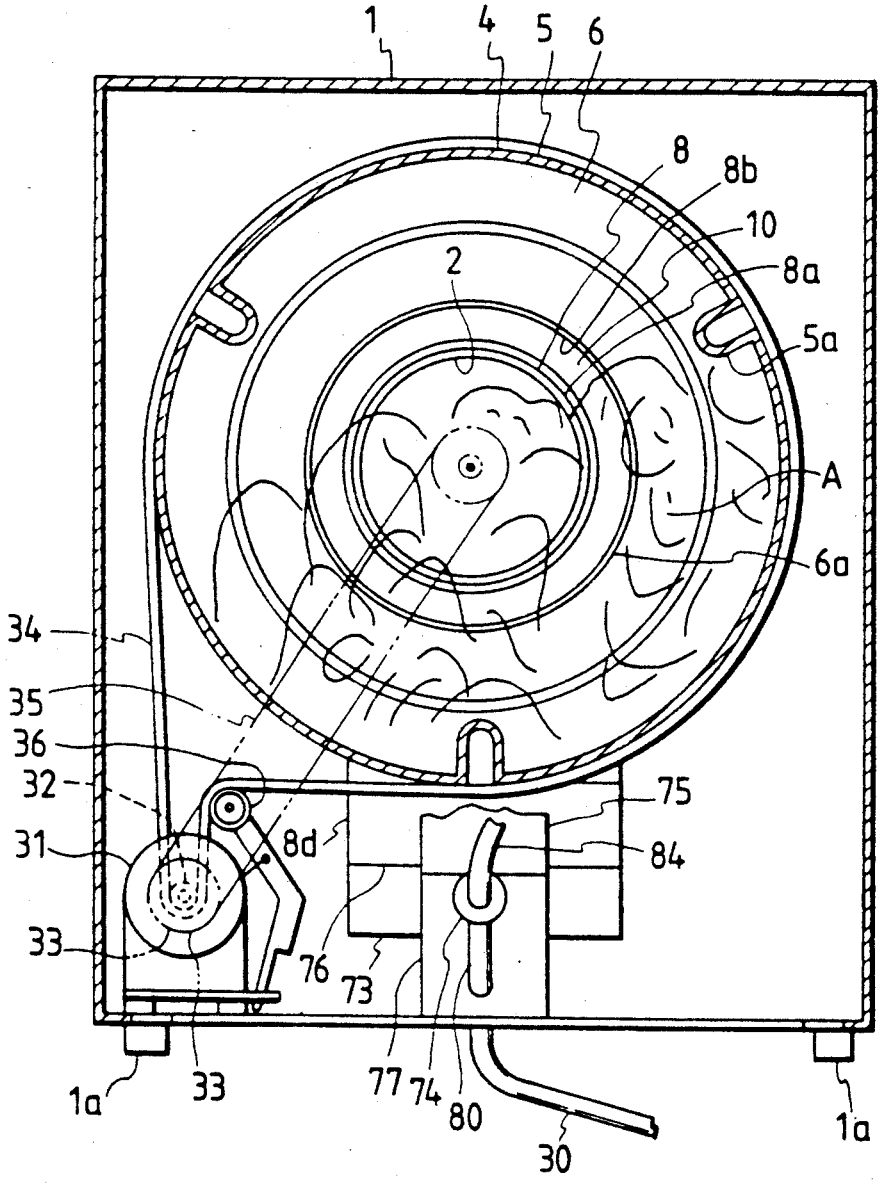
FIG. 10 is a vertical section view illustrating the fourth embodiment as viewed from a direction perpendicular to the surface of paper of FIG. 9.
Figure 11:
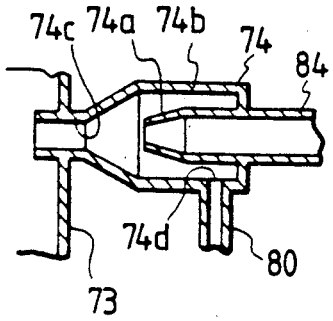
FIG. 11 is a section view of a major portion for illustrating in detail the structure of a water jet pump of FIG. 9.

FIG. 9 is a vertical section view illustrating the clothes dryer according to a fourth embodiment of the present invention. FIG. 10 is a vertical section view as viewed from a direction perpendicular to the surface of paper of FIG. 9. FIG. 11 is a section view of an important portion to explain in detail the structure of the water jet pump of FIG. 9.

In the clothes dryer of this embodiment, the condensation unit is constituted by a first duct 75, a second duct 76, a cooling water-containing portion 77, a water drain pipe 78, a water inlet port 79, a water jet pump 74, and a water suction pipe 80. The first duct 75 is connected at its one end to the delivery side of the casing 12 of the circulating fan 20, and is arranged with its other end being directed downwardly of the dryer housing. The second duct 76 is connected at its one end to the other end of the first duct 75, and is connected at its other end to the duct 8*d* which contains the heater 26. The cooling water-containing portion 77 is formed in the bottom of the second duct 76 to contain the cooling water. The upper end of the water drain pipe 78 is located above the bottom of the cooling water-containing portion 77. The water inlet port 79 is opened in the side lower portion of the cooling water-containing portion 77. The water jet pump 74 is mounted on the side upper portion of the cooling water-containing portion 77. The water suction pipe 80 connects the water jet pump 74 to the water inlet port 79. As illustrated in detail in FIG. 11, the water jet pump 74 consists of a nozzle portion 74*a* connected to the water-feed solenoid valve 27, a jet 74*c* which is provided in front of the nozzle portion 74*a* to inject water into the second duct 76, a suction port 74*d* to which the water suction pipe 80 is connected, and a suction portion 74*b* which is so formed as to surround the nozzle portion 74*a*.

In FIG. 9, the same reference numerals as those of FIG. 1 denote the same portions. Reference numeral 20 denotes a circulating fan that is rotatably supported by the fan shaft 19, that sucks from the drum 4 the humid air containing water vaporized from the laundry A and that circulates it to the condensation unit 73 which will be described below, heater 26, and the drum 4. Reference numeral 73 denotes a condensation unit for condensing water contained in the humid air blown by the circulating fan 20. The condensation unit 73 is constituted by the water jet pump 74, first duct 75, second duct 76, cooling water-containing portion 77, water drain pipe 78, water inlet port 79 and suction pipe 80. The water jet pump 74 is provided to inject and spray cooling water to the humid air (its details will be described later). The first duct 75 is connected to the delivery side of the fan casing 12 and is disposed being directed downwardly of the dryer housing. The second duct 76 is connected at its one end to the lower end of the first duct 75 and is connected at its other end to the duct 8*d* of the drum support member 8. The cooling water-containing portion 77 is formed on the bottom of the second duct 76 to temporarily store the cooling water that was injected and sprayed. The water drain pipe 78 is raised from the buttom surface of the cooling water-containing portion 77 and is so arranged that an opening 78*a* thereof is positioned higher than the water inlet port 79 that is described below. The water inlet port 79 is opened near the bottom surface of the cooling water-containing portion 77. The suction pipe 80 connects the water inlet port 79 to the suction port 74*d* of the water jet pump 74.

Reference numeral 27 denotes a solenoid valve for feeding water of the type of small flow rate that is provided for feeding city water to the water jet pump 74. Reference numeral 29 denotes a water pouring hose that connects the delivery side of the solenoid valve 27 to the nozzle portion 74*a* of the water jet pump 74. Reference numeral 30 denotes a water drain hose connected to the water drain pipe 78.

In FIG. 10, the same reference numerals as those of FIG. 2 denote the same portions.

Structure of the water jet pump 74 will now be described in detail in conjunction with FIG. 11.

The water jet pump 74 comprises (1) a nozzle portion 74*a* connected to the tip 84 of the pouring hose 29, and (2) a suction portion 74*b* that contains the nozzle portion 74*a*, and that has a jet 74*c* for cooling water and a suction port 74*d* to which the suction pipe 80 is connected, the nozzle portion 74*a* and the suction portion 74*b* being constituted as a unitary structure. Cooling water fed from the pouring hose 29 via feed-water solenoid valve 27 is injected from the nozzle portion 74*a*, and is injected and sprayed into the condensation unit 73 being mixed at the jet 74*c* with cooling water sucked from the cooling water-containing portion 77 via suction pipe 80.

Described below is the drying operation of the thus constituted clothes dryer.

The user throws the laundry A into the drum 4, closes the cover 3, turns on the clothes dryer to supply electric power to the drive motor 31, heater 26 and solenoid valve 27 for feeding water. The drive motor 31 then rotates whereby the drum 4 rotates at a speed of about 40 rpm, the circulating fan 20 rotates and, at the same time, the solenoid valve 27 is opened, and the cooling water B is injected and sprayed into the condensation unit 73. The laundry A in the drum 4 is agitated by the lifter 5*a*. The air blown from the delivery side of the casing 12 of circulating fan 20 passes through the condensation unit 73, is heated by the heater 26 and becomes hot air having a relative humidity of, generally, lower than 2%. The hot air is blown into the drum 4 from the hot air blow port 10. The hot air comes into contact with the laundry A to vaporize the water contained therein; i.e., the humid air containing vaporized water is formed. The humid air is brought out from the drum 4 and is sent to the condensation unit 73 where it is cooled upon contact with the cooling water B injected from the water jet pump 74. The air after dehumidification is heated by the heater 26 and is blown into the drum 4. The laundry A is dried by the circulation of the air. Part of the water condensed during this step circulates together with the cooling water C through the condensation unit 73 owing to the water jet pump 74, and the remainder is drained together with the cooling water C out of the dryer housing from the drain pipe 78 via drain hose 30.

According to the embodiment described in the foregoing, the cooling water supplied via the feed-water solenoid valve 27 and the cooling water C in the cooling water-containing portion 77 sucked by the water jet pump 74 are mixed together by the water jet pump 74, and are injected and sprayed into the humid air from the drum 4 to cool it. Therefore, the cooling water is utilized in large amounts compared with the amount of water that is fed, and the heat is transferred in increased amounts from the humid air to the cooling water. Therefore, the cooling water fed through the feed-water solenoid valve 27 can be saved.

Figure 12:
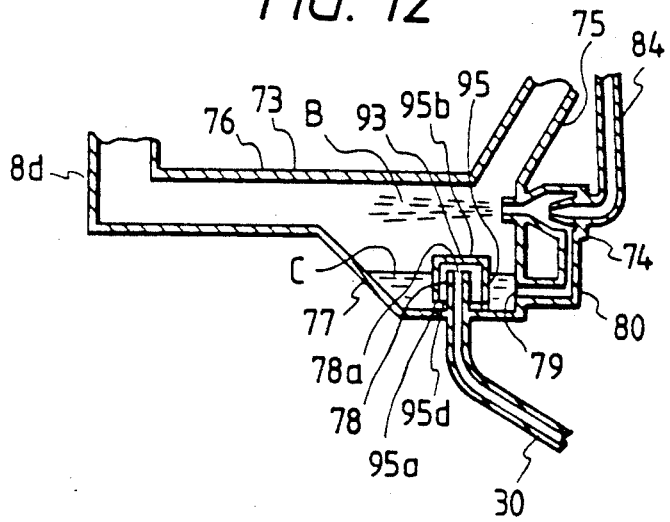
FIGS. 12 and 13 are section views illustrating the condensation units in the clothes dryers according to fifth and sixth embodiments of the present invention.

FIG. 12 is a section view illustrating a condensation unit of the clothes dryer according to a fifth embodiment of the present invention.

The condensation unit according to the fifth embodiment is quite the same as that of the embodiment of FIG. 9 except that the water drain pipe in the condensation unit has an opening constructed as a siphon.

In FIG. 12, the same reference numerals as those of FIG. 9 denote the same portions. Reference numeral 93 denotes a siphon that is disposed on the bottom of the cooling water-containing portion 77 of condensation unit 73 to drain the cooling water C and condensed water. The siphon 93 has the water drain pipe 78 that rises from the bottom surface and that has the opening 78*a* positioned over the water inlet port 79, and a cap-like drum 95 having an upper bottom portion 95*b* that covers the water drain pipe 78 and that maintains a gap 95*d* between the bottom surface of the cool water-containing portion 77 and the lower end surface 95*a*.

Being constituted as described above, the cooling water C in the cooling water-containing portion 77 is intermittently drained. That is, as the water level of the cooling water C rises and exceeds the opening 78*a* of water drain pipe 78, the water starts to drain. The water ceases to drain when the water level drops to lower than the lower end surface 95*a* of the drum 95.

Further, as far as the water level of cooling water C remains lower than the water inlet port 79, the cooling water B injected and sprayed into the humid air from the water jet pump 74 is all the one that is fed through the solenoid valve 27. As the level of cooling water C becomes higher than the water inlet port 79, the water that is injected and sprayed is the sum of the above-mentioned water and part of cooling water C sucked by the water jet pump 74.

According to the fifth embodiment, the cooling water C exists at all times between the opening 78*a* the lower end surface 95*a* of the drum 95 in the condensation unit 73, and the humid air is prevented from leaking from the water drain pipe 78.

Figure 13:
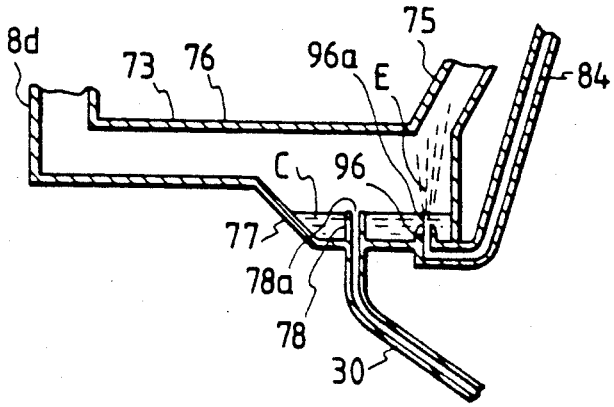

FIG. 13 is a section view illustrating a condensation unit in the clothes dryer according to a sixth embodiment of the present invention.

The sixth embodiment is the same as the aforementioned embodiment except that the water is injected in the condensation unit by using a nozzle mentioned below instead of the water jet pump used in the embodiment of FIG. 9.

In FIG. 13, the same reference numerals as those of FIG. 9 denote the same portions. Reference numeral 96 denotes a nozzle that is provided on the bottom of the cooling water-containing portion 77 with its jet 96*a* being upwardly directed maintaining a height lower than the height of opening 78*a* of the water drain pipe 78. The nozzle 96 injects the cooling water that is fed through the pouring hose 29 via solenoid valve 27. The gushing flow E agitates the cooling water C and causes part of the cooling water to be scattered into the condensation unit 73. Due to the gushing flow E from the nozzle 96, the water contained in the humid air is condensed as it passes through the condensation unit 73.

According to the sixth embodiment, the humid air is cooled with the injected water stream that consists of cooling water supplied through the feed-water solenoid valve 27 and part of the cooling water C splashed by the gushing flow E of the nozzle 96. Therefore, the amount of cooling water becomes greater than the amount of water that is fed, contributing to decreasing the amount of cooling water fed via the solenoid valve 27. Described below is a concrete example using the clothes dryer of FIG. 9. The amount of cooling water fed via the solenoid valve 27 is 0.3 l/min (water temperature is 20° C.). The electric power consumed by the heater 26 is 1 kW. The amount of the air passing through the condensation unit is 1.0 $m^3$/min. The clothes to be dried were 3.5 kg of wet cotton fabric containing 75% of water. In this case, the temperature difference between the humid air before it is cooled and after it is cooled becomes twice as great as when the water jet pump 74 is not provided but the cooling water is simply supplied in the above-mentioned amount to the condensation unit 73. Furthermore, the amount of condensed water (which is recovered and measured) up to when the drying is finished becomes 1.4 times as great.

With the clothes dryer of the present invention as described above, the circulating humid air is heated and is then cooled to dry the laundry. That is, the humid air containing water vaporized from the laundry A contained in the drum 4 is expelled from the drum 4 by the circulating fan 20 and is sent to the condensation unit 23 (or 38 or 73) where the cooling water is sprayed into the humid air to lower its temperature. In this step, the humid air turns into saturated air whereby the water contained therein is condensed and the temperature drops. The air (humid air) after dehumidification is heated by the heater 26 and is supplied to the drum 4. In this step, the humid air is heated and turns into the air (humid air) having a small relative humidity. The air (humid air) sent to the drum 4 comes into contact with the laundry A to vaporize water contained in the laundry A, and its temperature is lowered as it becomes humid air having a high relative humidity. The humid air is expelled again from the drum 4 and circulates. Therefore, the laundry A is dried.

The clothes dryer of the present invention makes it possible to efficiently cool the humid air to increase the amount of dehumidified water in the aforementioned drying system. The results of experiments are shown in FIG. 14.

Figure 14:
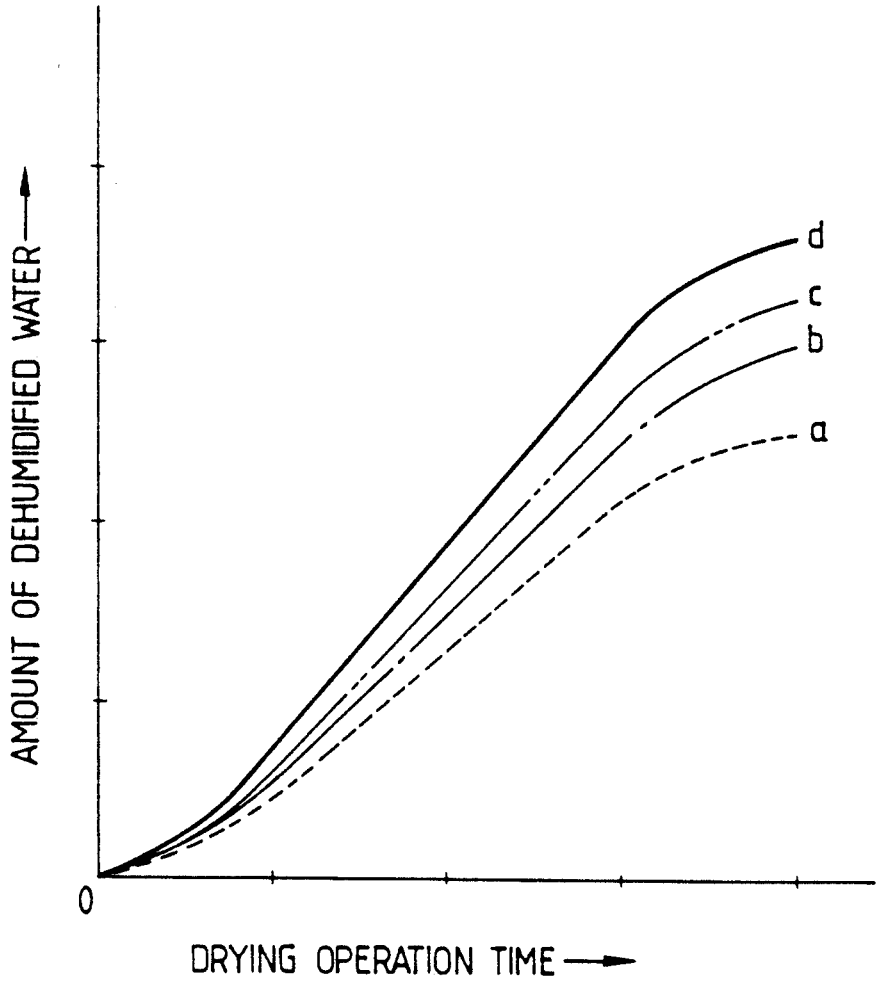
FIG. 14 is a graph showing relationships between the drying operation time and the amount of dehumidified water according to embodiments of the present invention.

FIG. 14 is a graph showing relationships between the drying time and the amount of dehumidified water according to embodiments of the present invention. FIG. 14 shows measured results of when 3.5 kg of wet cotton fabric containing 75% of water is dried using clothes dryers of FIGS. 1 to 13 while setting the amount of cooling water fed via the solenoid valve 27 to be 0.3 l/min (water temperature is 20° C.), the amount of electric power consumed by the heater 26 to be 1.00 to 1.15 kW, and the circulating amount of the humid air to be 0.8 to 1.0 $m^3$/min. In FIG. 14, a curve a represents the amount of dehumidified water that is recovered when the resistor R is not provided in FIGS. 3 and 4. Curve b represents the amount of dehumidified water that is recovered according to the second embodiment of FIGS. 3 and 4. Curve c represents the amount of dehumidified water that is recovered according to the first embodiment of FIGS. 1 and 2, according to the fourth embodiment of FIGS. 9 and 10, and according to the sixth embodiment of FIG. 13. Curve d represents the amount of dehumidified water recovered according to the third embodiment of FIG. 8.

It will be understood from FIG. 14 that the humid air is efficiently cooled according to the embodiments of the present invention, and the amounts of dehumidified water are increased, too.

What is claimed is:

1. A clothes dryer which comprises:

a drum which is horizontally supported by bearings in a dryer housing and which contains a laundry therein;

a condensation unit which cools the humid air containing vapor generated from said laundry, and which condenses the vapor contained in the humid air to remove it;

a heater accommodated in a heater duct for heating the air that is dehumidified through the condensation unit; and a circulating fan which supplies the humid air in said drum to said condensation unit, supplies the air in said condensation unit to the surrounding of said heater, and supplies the air from the surrounding of said heater into said drum; wherein said condensation unit comprises:

a first duct which is connected at its one end to the delivery portion of said circulating fan and which is arranged with its other end being directed downwardly of the dryer housing;

a second duct which is connected at its one end to the other end of the first duct and which is connected at its other end to said heater duct that accommodates said heater;

a cooling water pouring port for feeding cooling water to the second duct;

cooling means for bringing said cooling water into direct contact with said humid air; and a water drain port for draining from said second duct the water condensed from said humid air and said cooling water, and wherein said cooling water pouring port is positioned in the upper surface of said second duct in the vicinity of said heater duct, and works to pour said cooling water, and wherein said cooling means is provided with a resistor which is mounted on the bottom surface of said second duct to widen the width of flow of said cooling water.

2. A clothes dryer which comprises:

a drum which is horizontally supported by bearings in a dryer housing and which contains a laundry therein;

a condensation unit which cools the humid air containing vapor generated from said laundry, and which condenses the vapor contained in the humid air to remove it;

a heater accommodated in a heater duct for heating the air that is dehumidified through the condensation unit; and a circulating fan which supplies the humid air in said drum to said condensation unit, supplies the air in said condensation unit to the surrounding of said heater, and supplies the air from the surrounding of said heater into said drum; wherein said condensation unit comprises:

a first duct which is connected at its one end to the delivery portion of said circulating fan and which is arranged with its other end being directed downwardly of the dryer housing;

a second duct which is connected at its one end to the other end of the first duct and which is connected at its other end to said heater duct that accommodates said heater;

a cooling water pouring port for feeding cooling water to the second duct;

cooling means for bringing said cooling water into direct contact with said humid air; and a water drain port for draining from said second duct the water condensed from said humid air and said cooling water, and wherein said cooling water pouring port is positioned in the upper surface of said second duct in the vicinity of said heater duct, and works to pour said cooling water.

3. A clothes dryer according to claim 2, wherein said second duct is upwardly directed maintaining a predetermined inclination from the lower end of said first duct and is connected to said heater duct.

4. A clothes dryer according to claim 2, wherein said cooling water pouring port consists of a plurality of small holes formed in the side surface of said first duct (24) and works to spray said cooling water.

5. A clothes dryer according to claim 2, wherein said cooling water pouring port is positioned in the upper surface of said second duct (40) in the vicinity of said heater duct (**8*d***), and works to pour said cooling water.

6. A clothes dryer according to claim 5, wherein said cooling means is provided with a resistor (45) mounted on said second duct (40) at a position opposed to said cooling water pouring port, said resistor (45) having water permeability and air permeability.

7. A clothes dryer according to claim 2, wherein:

(a) said second duct (76) comprises:

(i) a cooling water-containing portion (77) which is provided in the bottom of the second duct (76) to contain water; and (ii) a water drain pipe (78) of a protruded shape provided on the bottom surface of the cooling water-containing portion (77);

(b) said water drain port is provided in the upper end of said water drain pipe (78); and (c) said cooling means comprises:

(i) a water inlet port (79) positioned at a side lower portion of said cooling water-containing portion (77);

(ii) a water jet pump (74) provided at a side upper portion of said cooling water-containing portion (77); and (iii) a suction pipe (80) that connects the water jet pump (74) to said water inlet port (79).

8. A clothes dryer according to claim 7, wherein said water jet pump (74) is constituted by:

(a) a nozzle (**74*a*) to which said cooling water is fed and which injects said cooling water that is fed; and (b) a suction portion which is so formed as to surround the nozzle (74*a*) and which guides the water stored in said cooling water-containing portion (77) to said nozzle (74*a***).

9. A clothes dryer according to claim 8, wherein said suction portion has:

(a) a jet (**74*c*) that is provided in front of said nozzle (74*a*) and that injects water into said second duct (76); and (b) a suction port (74*d*) to which said suction pipe (80**) is connected.

10. A clothes dryer according to claim 1, wherein:

(a) said second duct (76) is equipped with:

(i) a cooling water-containing portion (77) which is provided in the bottom of the second duct (76) to store water;

(ii) a water drain pipe (78) of a protruded shape provided on the bottom surface of the cooling water-containing portion (77); and (iii) a cap-like drum (95) which is positioned near the upper end of the water drain pipe (78) so as to cover the upper end of said water drain pipe (78); and (b) said water drain port is formed in the upper end of said water drain pipe (78).

11. A clothes dryer according to claim 2, wherein:

(a) said second duct (76) is provided with:

(i) a cooling water-containing portion (77) that is provided in the bottom of the second duct (76) to store water; and (ii) a water drain pipe (78) of a protruded shape provided on the bottom surface of the cooling water-containing portion (77);

(b) said water drain port is formed in the upper end of said water drain pipe (78); and (c) said cooling means has a nozzle (96) provided on the bottom surface of said cooling water-containing portion (77), said nozzle (96) being fed with said cooling water to upwardly inject said cooling water that is fed.

* * * * *